US009283446B2

(12) United States Patent
Motokawa

(10) Patent No.: US 9,283,446 B2
(45) Date of Patent: Mar. 15, 2016

(54) GOLF CLUB

(71) Applicant: DUNLOP SPORTS CO. LTD., Kobe-shi, Hyogo (JP)

(72) Inventor: Yuki Motokawa, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/312,257

(22) Filed: Jun. 23, 2014

(65) Prior Publication Data

US 2015/0024866 A1 Jan. 22, 2015

(30) Foreign Application Priority Data

Jul. 16, 2013 (JP) ..... 2013-147840

(51) Int. Cl.
*A63B 53/02* (2015.01)
*A63B 53/04* (2015.01)

(52) U.S. Cl.
CPC ..... *A63B 53/02* (2013.01); *A63B 53/0466* (2013.01); *A63B 2102/32* (2015.10); *A63B 2243/0029* (2013.01)

(58) Field of Classification Search
CPC ..... A63B 53/02; A63B 2243/0029; A63B 53/0466; A63B 2102/32
See application file for complete search history.

(56) References Cited

U.S. PATENT DOCUMENTS

| | | | | |
|---|---|---|---|---|
| 5,540,435 | A * | 7/1996 | Kawasaki | A63B 53/02 473/309 |
| 8,961,330 | B2 * | 2/2015 | Zimmerman | A63B 53/02 473/246 |
| 9,168,427 | B1 * | 10/2015 | Aguinaldo | A63B 53/02 |
| 2012/0071261 | A1 | 3/2012 | Yamamoto | |
| 2013/0085010 | A1 * | 4/2013 | Beach | A63B 53/02 473/307 |
| 2013/0123038 | A1 * | 5/2013 | Cole | A63B 53/02 473/307 |

FOREIGN PATENT DOCUMENTS

| | | | | |
|---|---|---|---|---|
| GB | 599993 | A * | 3/1948 | F16L 35/00 |
| JP | 2012-86010 | A | 5/2012 | |

* cited by examiner

*Primary Examiner* — Stephen Blau
(74) *Attorney, Agent, or Firm* — Birch, Stewart, Kolasch & Birch, LLP

(57) ABSTRACT

A golf club includes a golf club head and a shaft attached to the golf club head, the golf club including the golf club head provided with a shaft insertion hole having an upper opening and a lower opening, the shaft insertion hole having an internal surface provided with an undercut groove, the shaft having a tip end, a shaft sleeve adaptor attached to the tip end of the shaft, the shaft sleeve adaptor inserted into the shaft insertion hole through the upper opening and having a first thread portion, a fastener comprising a second thread portion engaging with the first thread portion of the shaft sleeve adaptor through the lower opening of the shaft insertion hole, and a washer held in the undercut groove of the shaft insertion hole and disposed between the fastener and the shaft sleeve adaptor.

7 Claims, 9 Drawing Sheets

GOLF CLUB

BACKGROUND OF THE INVENTION

1. Field of the Invention

The present invention relates to a golf club including a golf club head and a shaft detachably attached to the golf club head.

2. Description of the Related Art

The Japanese Unexamined Patent Application Publication No. 2012-86010 discloses a golf club including a golf club head and a shaft detachably attached thereto. The golf club, for instance, includes a hosel having a shaft insertion hole having an upper opening into which a tip end of the shaft is inserted. Prior to insert into the shaft insertion hole, the tip end of the shaft is fixed to a shaft sleeve adaptor having a first thread portion. The shaft insertion hole further includes a lower opening where a fastener having a second thread portion is inserted to be engaged with the first thread portion. Consequently, the shaft is fixed to the golf club head through the shaft sleeve adaptor. The golf club described above has advantage of offering an opportunity to exchange the shaft or golf club head by the golfer.

The golf club includes a washer arranged between the shaft and the fastener to firmly fix so that a loose or rattle between the shaft and the fastener is prevented. Unfortunately, the washer often falls out from the golf club head at the time the shaft sleeve adaptor is removed from the golf club head by a golfer, and then it may easily be lost.

SUMMARY OF THE INVENTION

The present invention has been worked out in light of the circumstances described above, and has a main object of providing a golf club having a feature for exchanging the shaft without falling off the washer from the golf club head.

According to one aspect of the invention, a golf club includes a golf club head and a shaft attached to the golf club head. The golf club includes the golf club head provided with a shaft insertion hole having an upper opening and a lower opening, the shaft insertion hole having an internal surface provided with an undercut groove, the shaft having a tip end, a shaft sleeve adaptor attached to the tip end of the shaft, the shaft sleeve adaptor inserted into the shaft insertion hole through the upper opening and having a first thread portion, a fastener comprising a second thread portion engaging with the first thread portion of the shaft sleeve adaptor through the lower opening of the shaft insertion hole, and a washer held in the undercut groove of the shaft insertion hole and disposed between the fastener and the shaft sleeve adaptor.

In another aspect of the invention, the undercut groove may be formed by machining.

In another aspect of the invention, the shaft insertion hole may comprise a tapered portion extending downwardly toward the undercut groove.

In another aspect of the invention, the shaft insertion hole may have a circular cross-sectional shape, and the undercut groove may continuously extend in a circumferential direction of the internal surface of the shaft insertion hole.

In another aspect of the invention, the shaft insertion hole may be further provided with a longitudinal groove extending in an axial direction of the shaft insertion hole from the undercut groove to the lower opening.

In another aspect of the invention, the lower opening of the shaft insertion hole may have a regular polygonal shape having an even number of sides, the undercut groove may extend in a circumferential direction of the internal surface of the shaft insertion hole, and a diameter of the undercut groove may be substantially identical to a length of a diagonal of the regular polygonal shape of the lower opening.

In another aspect of the invention, a diameter of the undercut groove may be smaller than a length of a diagonal of the regular polygonal shape of the lower opening, but larger than a length of the side of the regular polygonal shape.

DETAILED DESCRIPTION

Figure 1:
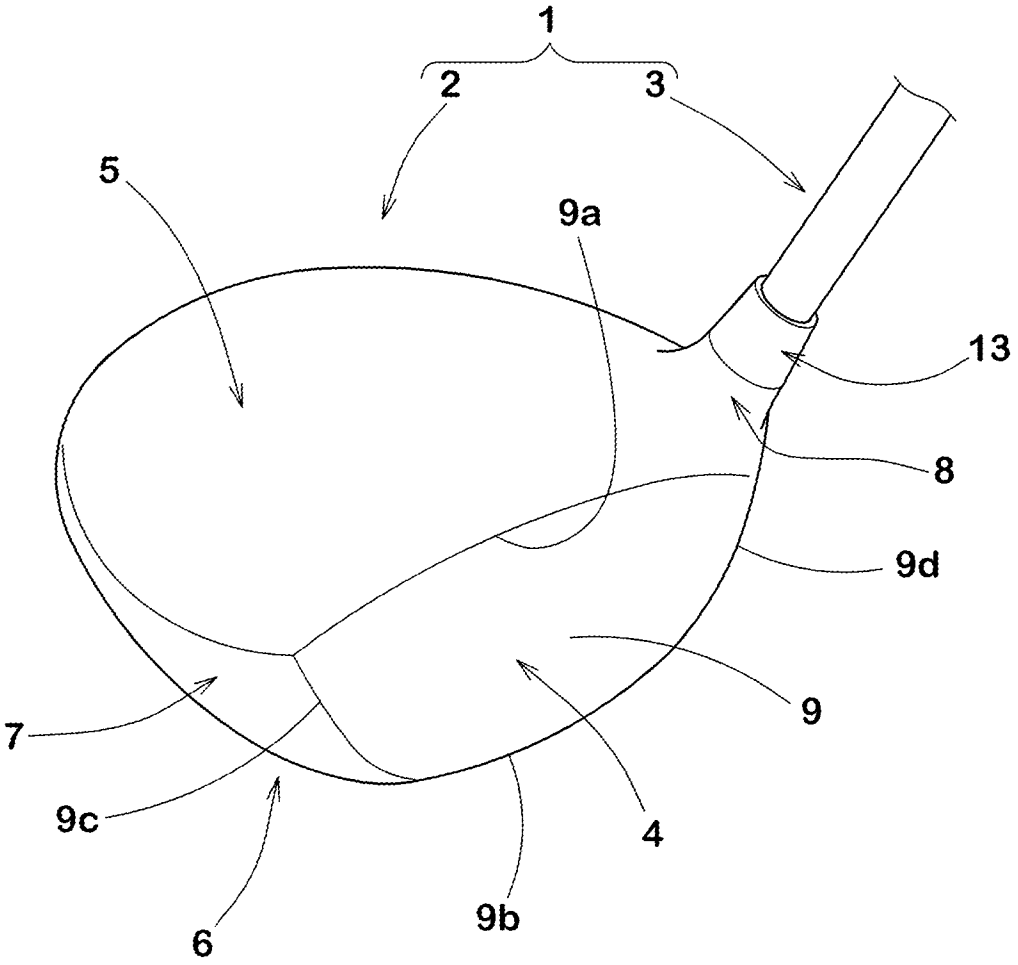
FIG. 1 is a perspective view illustrating a golf club in accordance with an embodiment of the present invention.

An embodiment of the present invention will be explained below with reference to the accompanying drawings. It should be noted that like elements are denoted by the same reference numerals throughout the disclosure.

FIG. 1 is a perspective view illustrating a golf club 1 in accordance with an embodiment of the present invention. The golf club 1 includes a golf club head (which may be hereinafter simply referred to as a "head") 2, and a shaft 3 that is detachably attached to the golf club head 2.

The head 2 in accordance with the present embodiment is configured as a wood type having a hollow (i) (shown in FIG. 2) provided therein. A concept of the wood-type golf club head is such that it includes at least Driver (#1), Brassy (#2), Spoon (#3), Baffy (#4), and Cleek (#5), and also includes heads which differ from them in the count number or a name but has an almost similar shape thereto. In another aspect of the present invention, the head 2 may be configured as an iron-type, a utility-type, or a putter-type.

The major part of the head 2 is preferably made of a metal material such as stainless steel, maraging steel, titanium, titanium alloy, magnesium alloy or aluminum alloy. For the head 2, plurality kinds of metal materials may be used. The head 2 may be partially made of a non-metal material such as fiber reinforced resin.

Referring back to FIG. 1, the head 2 includes a face portion 4, a crown portion 5, a sole portion 6, a side portion 7, and a hosel 8.

The face portion 4 includes a hitting face 9 for striking a golf ball. The hitting face 9 has an upper edge 9*a*, a lower edge 9*b*, a toe-side edge 9*c*, and a heel-side edge 9*d*. The crown portion 5 extends rearward from the upper edge 9*a* of the hitting face 9 so as to form a top surface of the head 2. The sole portion 6 extends rearward from the lower edge 9*b* of the hitting face 9 so as to form a bottom surface of the head 2. The side portion 7 extends from the toe-side edge 9*c* of the hitting face 9 to the heel-side edge 9*d* of the hitting face 9 through a rear of the head in between the crown portion 5 and the sole portion 6. Regarding the front-rear direction of the head 2, the front of the head 2 means the side which is near the hitting face 9, and the rear means the side apart from the hitting face 9.

Figure 2:
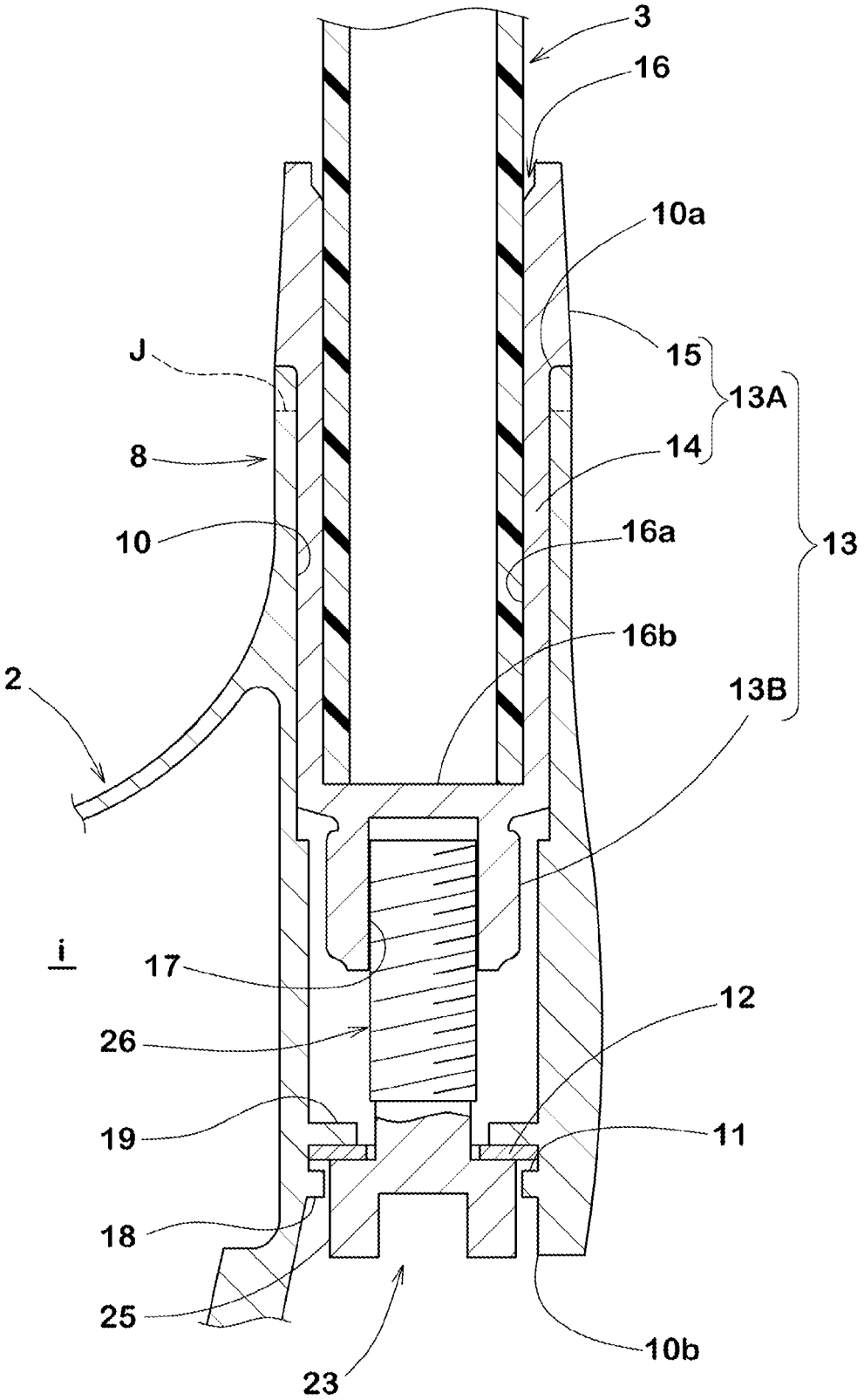
FIG. 2 is a longitudinal sectional view of a connected portion of a golf club head and a shaft of the golf club in accordance with an embodiment of the present embodiment.

The hosel 8 is provided on the heel side of the crown portion 5. FIG. 2 illustrates the longitudinal sectional view of the hosel 8. The hosel 8 is formed into a tubular shape having a shaft insertion hole 10.

The shaft insertion hole 10 is a through hole that comprises an upper opening 10*a* for insertion of the shaft 3 into the head 2, and a lower opening 10*b* that opens on the sole portion 6 (shown in FIG. 1). In this embodiment, the shaft insertion hole 10 is configured having a circular cross-sectional shape. The shaft insertion hole 10 includes an internal surface with an undercut groove 11 which is provided at the place near the lower opening 10*b*.

The shaft insertion hole 10 is provided with a lower internal flange 18 and an upper internal flange 19 so that the undercut groove 11 is formed therebetween. In this embodiment, the undercut groove is configures as a continuously extending groove in a circumferential direction of the shaft insertion hole 10. The undercut groove 11 has an internal diameter larger than a respective internal diameter of the lower and upper internal flanges 18 and 19.

In the space of the undercut groove 11, a washer 12 is held without falling off therefrom. For the washer 12, at least one of a plane washer and a spring washer may be employed, for instance. Preferably, the spring washer may be employed for the washer 12.

In one aspect of the embodiment, the washer 12 may be inserted into the undercut groove 11 from the lower opening 10*b* of the shaft insertion hole 10. When the washer 12 is inserted into the undercut groove 11, the washer 12 is elastically deformed so as to have a small outer diameter in order to pass through the lower internal flange 18. After passing through the lower internal flange 18, the washer 12 is able to restore to its original shape. Preferably, the size of the washer 12 may be decided such that a small gap between the washer 12 and the undercut groove 11 is provided. For instance, the washer 12 may have a diameter smaller than a diameter of the undercut groove 11, but it is larger than those of the lower and upper internal flanges 18 and 19. Furthermore, the washer 12 may have a thickness smaller than a groove width of the undercut groove 11. Thus, the washer 12 is held without falling off from the undercut groove 11.

The shaft 3 is made of a fiber reinforced plastic, for instance. The shaft 3 is formed into a pipe shape having a tip end to which a shaft sleeve adaptor 13 is attached.

The shaft sleeve adaptor 13 is made of a metal material. The shaft sleeve adaptor 13 comprises a sleeve body 13A into which the shaft 3 is inserted, and an axial portion 13B integrally formed below the sleeve body 13A.

The sleeve body 13A is formed into a pipe shape that has an axially extending bore 16. The bore 16 is configured as an upper opened hole defined by an inner surface 16*a* and a closed bottom surface 16*b*. The shaft 3 is previously bonded to the bore 16 by using adhesive agent, for example.

The sleeve body 13A integrally includes a first portion 14 inserted into the hosel 8, and a second portion 15 exposed outside the hosel 8. The second portion 15 includes a conical outer surface having a diameter for engaging the top of the hosel 8.

The shaft sleeve adaptor 13 with the shaft 3 is inserted into the shaft insertion hole 10 of the hosel 8 from the upper opening 10*a*. Thus, the shaft 3 is assembled to the head 2. Since the second portion 15 of the sleeve body 13A may engage with the top of the hosel 8, the shaft sleeve adaptor 13 may stay a certain position when it is inserted.

In one aspect of the embodiment, the top of the hosel 8 is configured as a first engaging portion, and the bottom of the second portion 15 is configured as a second engaging portion which firmly engages with the first engaging portion. Thus a tight locking system J between the shaft 3 and the head 2 is provided in order to prevent a rotation of the shaft 3 around its axial center line with respect to the head 2.

After inserting the shaft 3 with the shaft sleeve adaptor 13 into the shaft insertion hole 10, the bottom of the axial portion 13B of the shaft sleeve adaptor 13 is located upwardly with respect to the washer 12. The axial portion 13B of the shaft sleeve adaptor 13 includes a first thread portion. In this embodiment, the first thread portion is configured as a thread hole 17 (a female thread). The thread hole 17 extends upwardly from the bottom of the axial portion 13B in the axial direction of the shaft sleeve adaptor 13.

Figure 3:
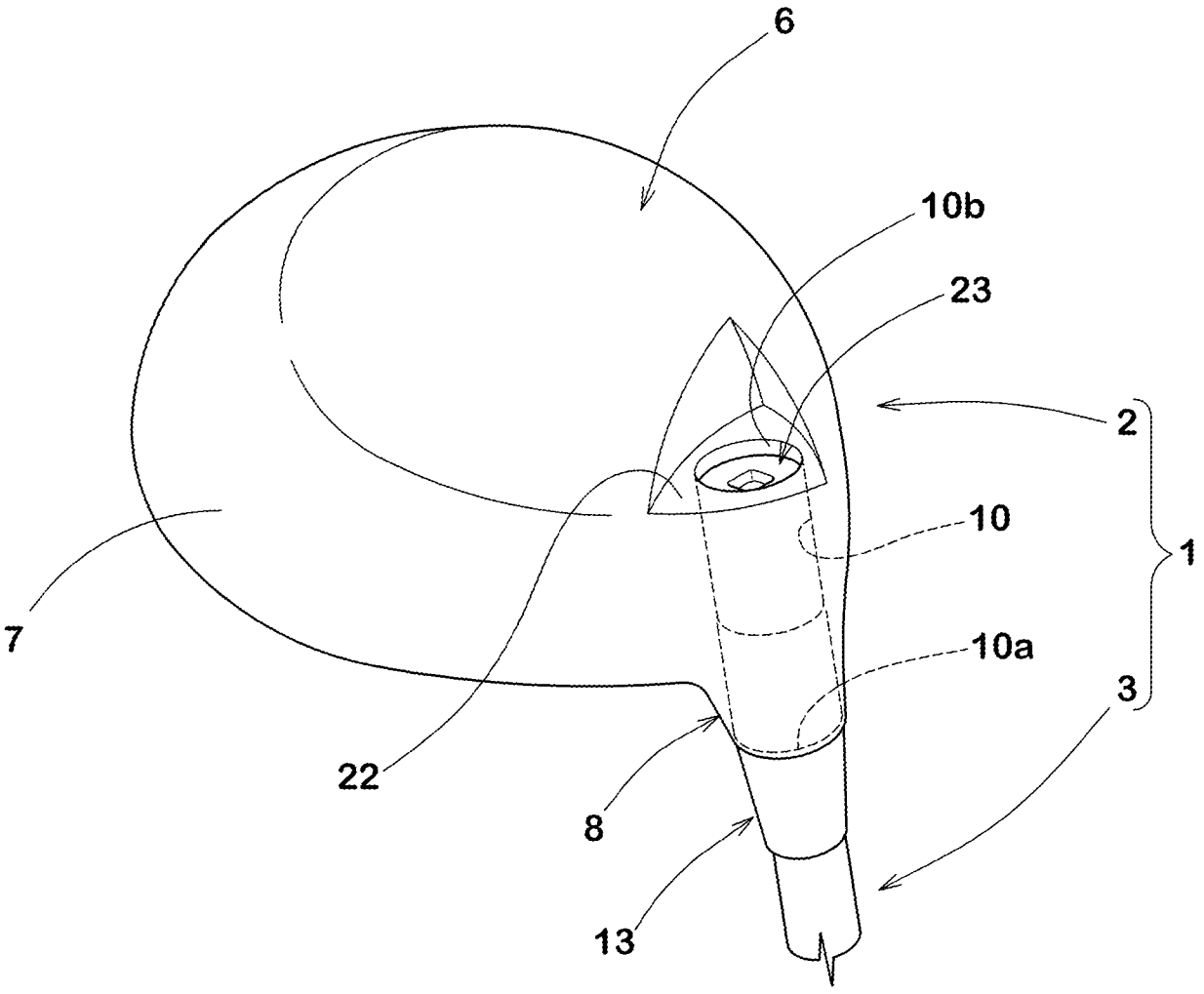
FIG. 3 is a perspective view of the golf club viewed from a bottom side of the golf club head.
Figure 4:
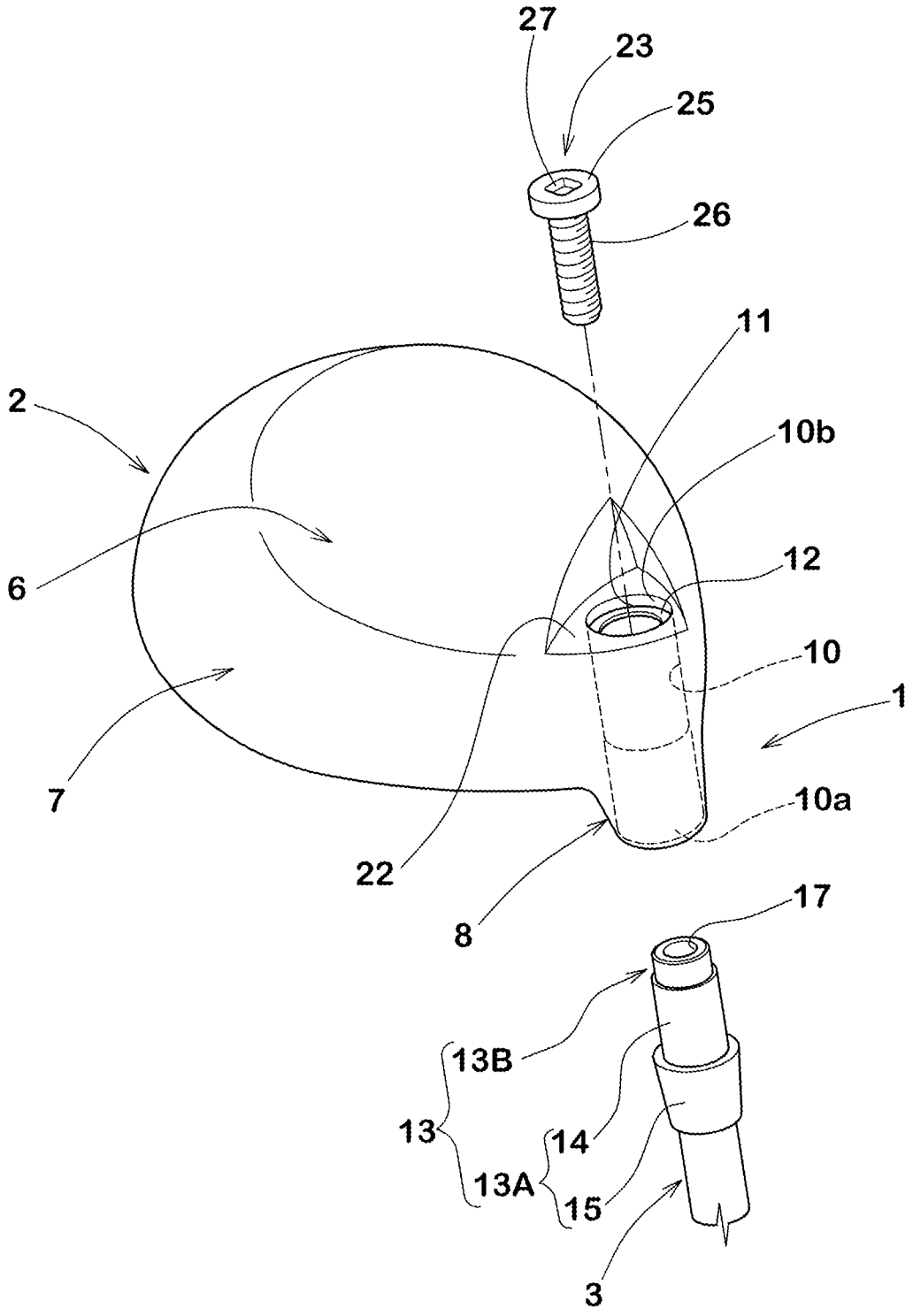
FIG. 4 is an exploded perspective view of the golf club of FIG. 3.

FIG. 3 illustrates a perspective view of the golf club 1 viewed from a bottom side of the golf club head 2, and FIG. 4 illustrates an exploded perspective view of the golf club 1 of FIG. 3. As shown in FIGS. 2 to 4, the lower opening 10*b* of the shaft insertion hole 10 is opened at the sole portion of the head 2. As shown in FIGS. 3 and 4, the sole portion 6 includes a recess 22 on its heel side. The lower opening 10*b* in accordance with the present embodiment is opened at the recess 22.

Through the lower opening 10*b*, a fastener 23 is engaged with the thread hole 17 to fix the shaft 3 to the head 2.

In this embodiment, the fastener 23 is configured as a bolt shape which comprises a head 25 located on the bottom side of the head 2, and a thread portion 26 as a second thread portion.

Preferably, the fastener 23 is made of a metal material such as stainless steel, titanium, aluminum alloy, clipper alloy, or tungsten steel. A resin material may be used for the fastener 23. In the preferable embodiment of the present invention, a plurality of fasteners 23 which have a respective different mass may be previously prepared. Then one of the fasteners 23 selected by the golfer is able to be employed to fix the shaft 3. Thus, the golfer may adjust weight providing to the heel side of the head 2 based on his or her choice so that the location of the center of gravity of the head 2 is adjusted in a toe-heel direction of the head 2. Furthermore, a weight balance of the golf club, a moment of inertia of the golf club 1, and a total mass of the golf club 1 may be adjusted by exchanging the fastener 23.

The head 25 is configured as a circular piece having a top with a socket 27 for fastening the shaft 3 to the club head 2 by a tool such as a wrench. Although the shape of socket 27 is configured as a rectangular in this embodiment, any shapes such as a hexagon and star-shaped be used.

As shown in FIG. 2, the fastener 23 is inserted into the shaft insertion hole 10 from the lower opening 10*b*, while the shaft 3 with the shaft sleeve adaptor 13 is inserted into the shaft insertion hole 10 from the upper opening 10*a*. As described above, the second portion 15 of the shaft sleeve adaptor 13 may engage with the top of the hosel 8, thereby preventing its downward movement and rotation.

Then the thread portion 26 of the fastener 23 is fastened into the thread hole 17 of the shaft sleeve adaptor 13 through the washer 12. Since the head 25 of the fastener 23 is not able to pass through the central hole of the washer 12, the fastener 23 stays there during screwing it onto the thread hole 17. Thus, by screwing the thread portion 26 into the thread hole 17 of the shaft sleeve adaptor 13, the shaft sleeve adaptor 13 is forced downwardly because the upward movement of the fastener 23 is limited by the washer 12 held in the undercut groove 11. Thus, the shaft 3 is firmly fixed to the hosel 8 through the shaft sleeve adaptor 13 which is acted high friction force between the second portion 15 and the top of the hosel 8. Furthermore, by firmly fastening the fastener 23 into the thread hole 17, the washer 12 is gradually and elastically deformed while applying the restoring force thereof to the fastener 23 so as to reduce vibration and rattle therebetween.

By removing the thread portion 26 of the fastener 23 from the thread hole 17 of the shaft sleeve adaptor 13, the shaft sleeve adaptor 13 with the shaft 3 is able to be detached from the shaft insertion hole 10 of the hosel 8 of the head 2. Accordingly, the golf club 1 in accordance with the present invention may be easily detached the shaft 3 from the head 2 and exchanged, by only a simple operation of fastening and releasing the fastener 23. Under these circumstances, since the washer 12 is held in the undercut groove 11, the washer 12 does not fall off from the head 2. It is very useful for golfers who exchange the shaft 3 because there is no chance losing the washer 12.

Figure 5A:
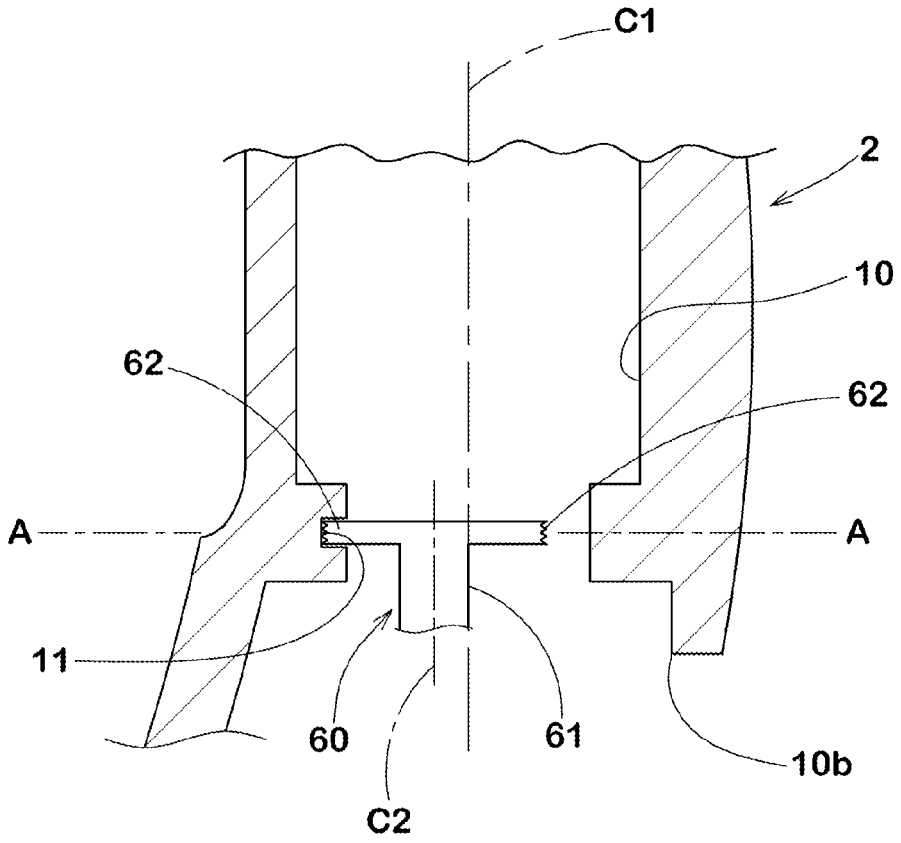
FIG. 5A is a longitudinal sectional view of a shaft insertion hole to explain an embodiment of a method of forming an undercut groove.
Figure 5B:
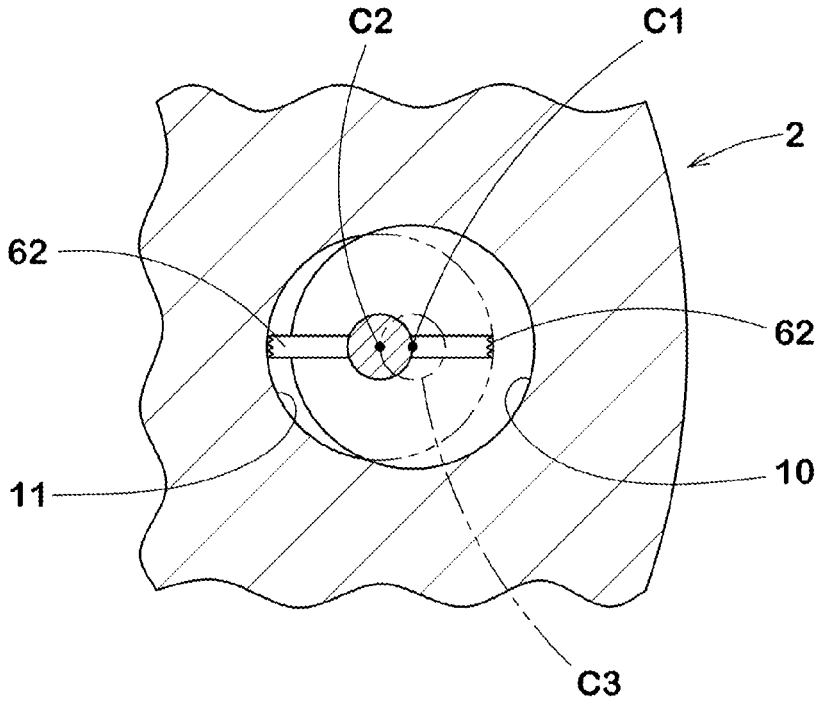
FIG. 5B is an end view taken along the line A-A of FIG. 5A.

FIGS. 5A and 5B illustrate an embodiment of a method of forming the undercut groove 11. FIG. 5A illustrates a longitudinal sectional view of the shaft insertion hole 10, and FIG. 5B is a end view taken along the line A-A of FIG. 5A. In these FIGs, "C1" denotes a center line of the shaft insertion hole 10. In order to form the undercut groove 11, a cutting tool 60 is inserted into the shaft insertion hole 10.

The cutting tool 60 includes a shaft body 61 having a center line C2 parallel to the center line C1 of the shaft insertion hole 10, and a pair of edged portions 62 and 62 protruding radially outward from the shaft body 61. Each edged portion 62 includes an edge for machining metal formed on its tip end. A diameter between the tip ends of the edged portions 62 is set smaller than an internal diameter of the shaft insertion hole 10 so that the cutting tool 60 can insert therein. The cutting tool 60 may rotate in high speed around its center line C2 to cut the internal surface of the shaft insertion hole 10 by its tip ends so as to form the undercut groove 11. Furthermore, the cutting tool 60 may revolve along an orbit C3 around the center line C1 of the shaft insertion hole 10 to form the continuously extending undercut groove 11 on the internal surface of the shaft insertion hole 10.

Figure 6A:
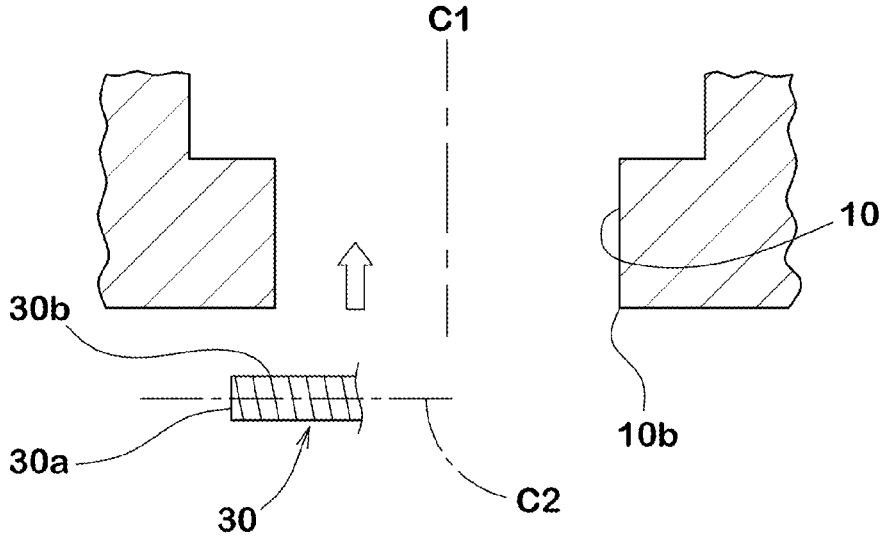
FIGS. 6A to 6C are longitudinal sectional views each illustrating the shaft insertion hole to explain a process of forming the undercut groove.
Figure 6B:
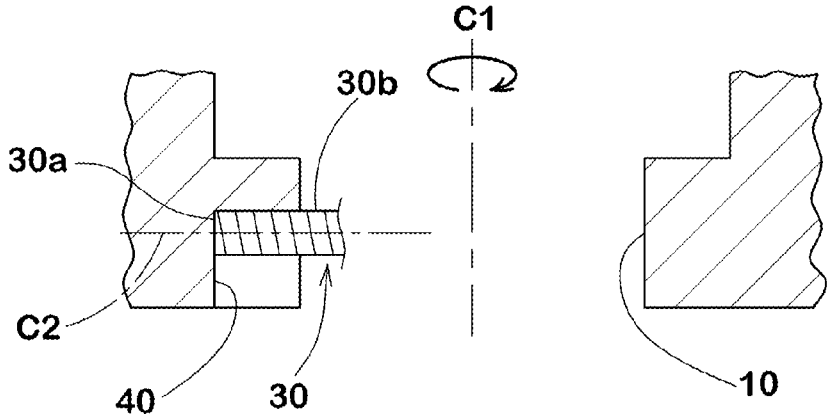
Figure 6C:
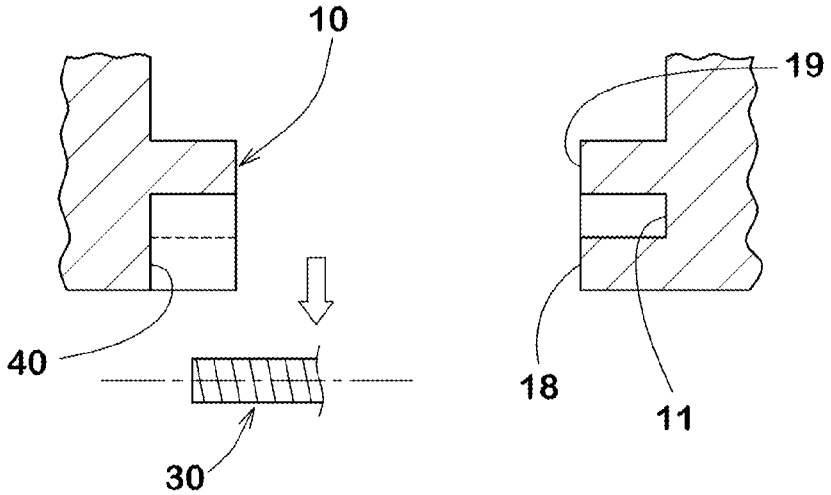
Figure 7:
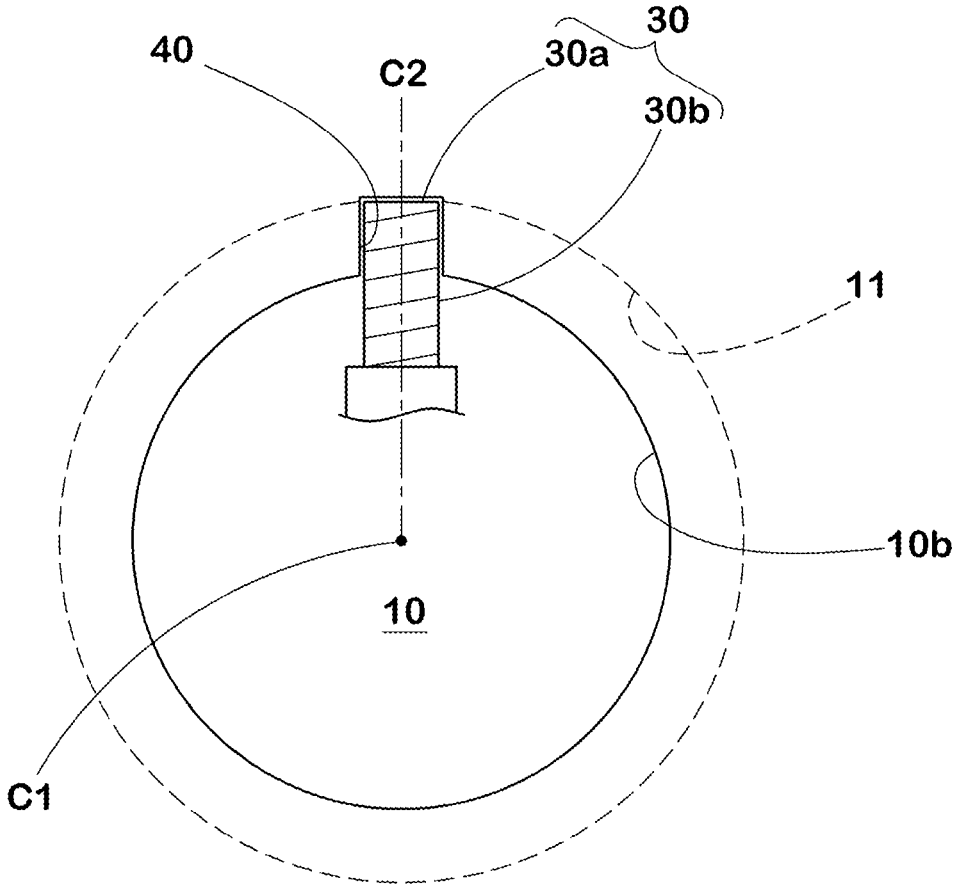
FIG. 7 is a bottom view of the shaft insertion hole.

FIGS. 6 and 7 illustrate another embodiment of a method of forming the undercut groove 11. FIG. 6A illustrates a longitudinal sectional view of the shaft insertion hole 10 in a state prior to forming the undercut groove 11 where "C1" denotes the center line of the shaft insertion hole 10. In order to form the undercut groove 11, a drill bit 30 which includes a tip end 30*a* and a lateral surface 30*b* is used. The drill bit 30 is rotated in high speed around its center line C2 that crosses the center line C1. Thus, the drill bit 30 may cut the internal surface of the shaft insertion hole 10 using its tip end 30*a* and the lateral surface 30*b*.

As shown in FIGS. 6A and 6B, which are longitudinal views of the shaft insertion hole 10, the lateral surface 30*h* of the drill bit 30 firstly comes into contact with the end face of the lower opening 10*b* of the shaft insertion hole 10 and then is forwarded upwardly. Thus, a longitudinal groove 40 is formed that extends upwardly from the lower opening 10*b*.

Next, as shown in FIGS. 6B to 6C, the drill bit 30 is moved so as to turn around the center line C1 at an angle of 360 degrees while rotating around its center line C2. Therefore the continuously extending undercut groove 11 in a circumferential direction of the shaft insertion hole 10 is formed. Then the drill bit 30 is taken out downwardly from the shaft insertion hole 10 through the longitudinal groove 40. Thus, the shaft insertion hole 10 is provided with the longitudinal groove 40 extending from the undercut groove 11 to the lower opening 10*b*.

Figure 8:
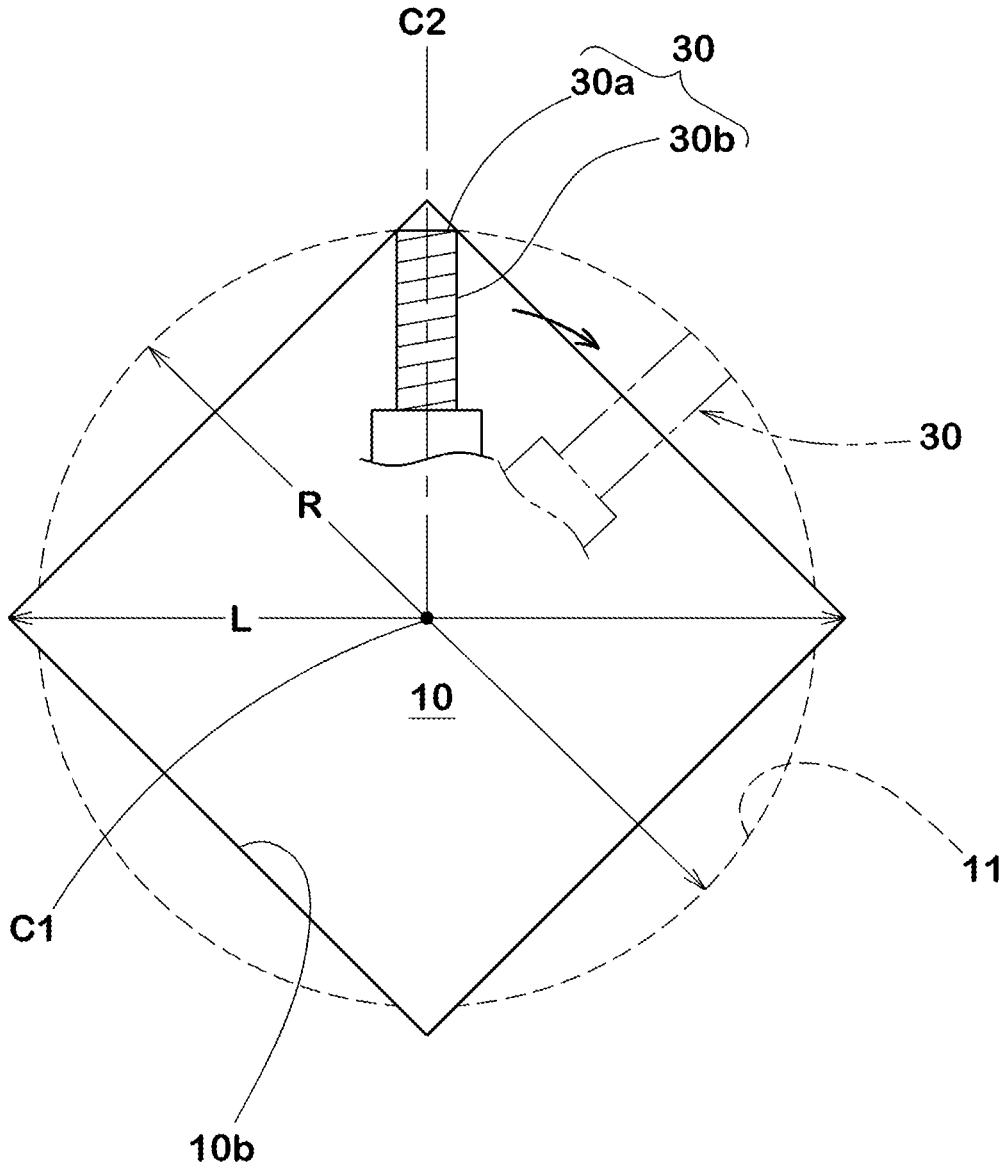
FIG. 8 is a bottom view of the shaft insertion hole to explain another embodiment of the method of forming the undercut groove.

FIG. 8 is a bottom view of the shaft insertion hole 10 to explain another embodiment of the method of forming the undercut groove 11. In this embodiment, the lower opening 10*b* of the shaft insertion hole 10 has a regular polygonal shape having an even number of sides. Here, the regular polygonal shape shall include a regular polygonal shape having a chamfered corner. FIG. 8 illustrates the lower opening 10*b* having a regular tetragon shape with four sides. In the embodiment shown in FIG. 8, the same elements recited in the embodiment shown in FIGS. 6A, 6B, 6C, and 7 are denoted using the same references.

To provide the undercut groove 11 on the internal surface of the shaft insertion hole 10, the drill bit 30 is inserted into the shaft insertion hole 10 from the lower opening 10*b*. As described above, the drill bit 30 is rotated in high speed around its center line C2 that crosses the center line C1 of the shaft insertion hole 10. Thus, the drill bit 30 may cut the internal surface of the shaft insertion hole 10 using its tip end 30*a* and the lateral surface 30*b*.

When the drill bit 30 is inserted into the shaft insertion hole 10, the drill bit 30 is arranged so that its center line C2 is aligned with one of the diagonals of the regular tetragon shape of the lower opening 10*b*. Furthermore, the tip end 30*a* of the drill bit 30 is positioned close to one of the corners of the regular tetragon shape of the lower opening 10*b*. From this positioning situation, the drill bit 30 is moved upwardly and then inserted into the shaft insertion hole 10 without coming into contact with the internal surface of the shaft insertion hole 10. In one aspect of the embodiment, the drill bit 30 may come into contact with the internal surface of the shaft insertion hole 10 during the upward movement. Then, the drill bit 30 is turned at angle of 360 around the center line C1 while rotating in high speed around its center line C2 in order to form the undercut groove 11 in a circular manner on the internal surface of the shaft insertion hole 10. Then the drill bit 30 is taken out downwardly from the shaft insertion hole 10 through the same position in which the drill bit 30 was inserted. As for the regular polygonal shape of the lower opening 10*b*, a regular hexagonal shape or a regular octagonal shape is preferably employed. In FIG. 8, "R" denotes a diameter of the under cut groove 11 which is substantially identical to a length L of the diagonal of the regular polygonal shape of the lower opening 10*b*. More preferably, the diameter R of the undercut groove 11 is set smaller than the length L of the diagonal, but larger than a length of the side of the regular polygonal shape.

Figure 9:
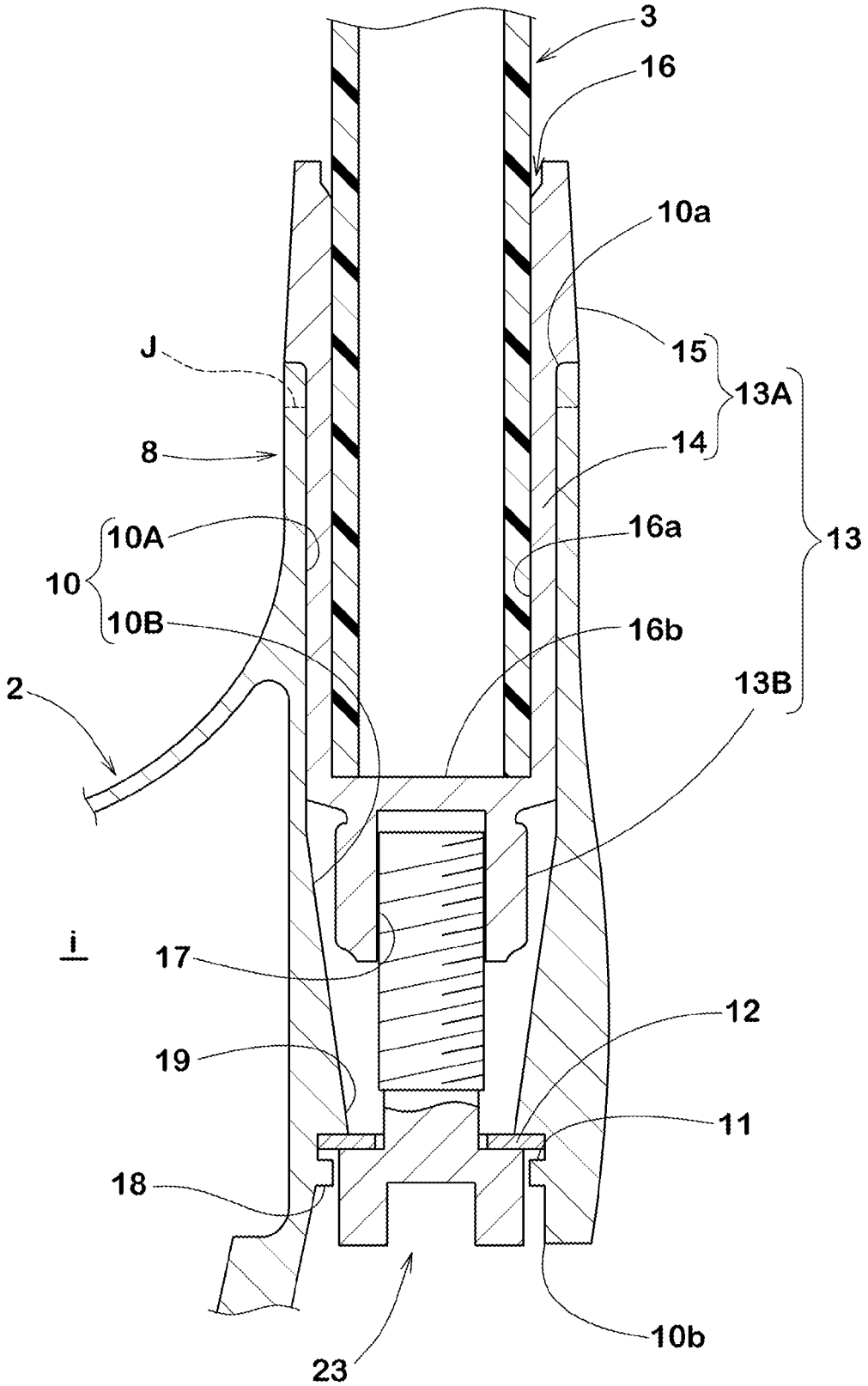
FIG. 9 is a longitudinal sectional view of the connected portion of the golf club head and the shaft of the golf club in accordance with another embodiment of the present embodiment.

FIG. 9 illustrates a longitudinal sectional view of the connected portion of the golf club head 2 and the shaft 3 in accordance with another embodiment of the present embodiment. In this embodiment, the shaft insertion hole 10 includes an upper portion 10A that extends downwardly from the upper opening 10*a* with a substantially constant internal diameter, and a tapered portion 10B that extends from the upper portion 10A toward the undercut groove 11 in a tapered manner. In this embodiment, the tapered portion 10B extends to the undercut groove 11 so that the upper internal flange 19 is configured as a tapered flange.

In this embodiment, the washer 12 has an outer diameter smaller than an internal diameter of the upper portion 10A of the shaft insertion hole 10. Accordingly, the washer 12 is able to put into the shaft insertion hole 10 from the upper opening 10*a* and pass through the upper portion 10A. Furthermore, the washer 12 is able to pass through the tapered portion 10B while reducing its outer diameter by a compression force acted by the internal surface of the tapered portion 10B by receiving a downward force from something. Then the washer 12 is able to inserted and held in the undercut groove 11. In this embodiment, the tapered portion 10B of the shaft insertion hole 10 may work as a guide member for easily introducing the washer 12 into the undercut groove.

While the particularly preferable embodiments of the present invention have been described in detail, the present invention is not limited to the illustrated embodiments, but can be modified and carried out in various aspects. For instance, the first thread portion may be configured as a male thread (external thread), and the second thread portion may be configured as a female thread (internal thread).

What is claimed is:

1. A golf club comprising a golf club head and a shaft attached to the golf club head, the golf club comprising:

the golf club head provided with a shaft insertion hole having an upper opening and a lower opening, the shaft insertion hole having an internal surface provided with an undercut groove;

the shaft having a tip end;

a shaft sleeve adaptor attached to the tip end of the shaft, the shaft sleeve adaptor inserted into the shaft insertion hole through the upper opening and having a first thread portion;

a fastener comprising a second thread portion engaging with the first thread portion of the shaft sleeve adaptor through the lower opening of the shaft insertion hole; and a washer held in the undercut groove of the shaft insertion hole and disposed between the fastener and the shaft sleeve adaptor wherein sides of the groove are adjacent each flat side of the washer such that the washer is held in the undercut groove no matter how the head is oriented when the fastener and the shaft sleeve are removed from the head.

2. The golf club according to claim 1, wherein the undercut groove is formed by machining.

3. The golf club according to claim 1, wherein the shaft insertion hole comprises a tapered portion extending downwardly toward the undercut groove.

4. The golf club according to claim 1, wherein the shaft insertion hole has a circular cross-sectional shape, and the undercut groove continuously extends in a circumferential direction of the internal surface of the shaft insertion hole.

5. The golf club according to claim 1, wherein the shaft insertion hole is further provided with a longitudinal groove extending in an axial direction of the shaft insertion hole from the undercut groove to the lower opening.

6. The golf club according to claim 1, wherein the lower opening of the shaft insertion hole has a regular polygonal shape having an even number of sides, the undercut groove extends in a circumferential direction of the internal surface of the shaft insertion hole, and a diameter of the undercut groove is substantially identical to a length of a diagonal of the regular polygonal shape of the lower opening.

7. The golf club according to claim 1, wherein the lower opening of the shaft insertion hole has a regular polygonal shape having an even number of sides, the undercut groove extends in a circumferential direction of the internal surface of the shaft insertion hole, and a diameter of the undercut groove is smaller than a length of a diagonal of the regular polygonal shape of the lower opening, but larger than a length of the side of the regular polygonal shape.

* * * * *